United States Patent [19]

Taylor et al.

[11] Patent Number: 4,940,858

[45] Date of Patent: Jul. 10, 1990

[54] IMPLANTABLE PULSE GENERATOR FEEDTHROUGH

[75] Inventors: William J. Taylor, Anoka; Douglas Weiss, Plymouth; Joseph F. Lessar, Coon Rapids, all of Minn.

[73] Assignee: Medtronic, Inc., Minneapolis, Minn.

[21] Appl. No.: 395,484

[22] Filed: Aug. 18, 1989

[51] Int. Cl.[5] ..... H01B 17/30

[52] U.S. Cl. ..... 174/152 GM; 403/272

[58] Field of Search ..... 174/50.61, 152 GM; 128/419 P; 403/28, 29, 30, 179, 272; 429/181

[56] References Cited

U.S. PATENT DOCUMENTS

| | | | |
|---|---|---|---|
| 4,180,700 | 12/1979 | Kraska et al. | 174/152 GM |
| 4,212,930 | 7/1980 | Athearn | 429/181 X |
| 4,225,262 | 9/1980 | Koop et al. | 174/152 GM X |
| 4,271,278 | 6/1981 | Phillips et al. | 429/213 X |
| 4,292,346 | 9/1981 | Athearn | 429/181 X |
| 4,307,162 | 12/1981 | Athearn | 429/121 |
| 4,556,613 | 12/1985 | Taylor et al. | 429/181 X |
| 4,678,868 | 7/1987 | Kraska et al. | 174/152 GM |
| 4,816,621 | 3/1989 | Huebner et al. | 174/152 GM |

OTHER PUBLICATIONS

Rhee, S. R., "Wetting of Ceramics by Liquid Metal", *Journal of The American Ceramic Society*, vol. 54, No. 7, pp. 332–334 (1971).

Memo dated 12/2/1981 from Sandia National Laboratories.

Douglas, S. C. et al., A Sandia Report SAND83-2301/2 (1984), "Ampule Tests to Simulate Glass Corrosion in Ambient Temperature Lithium Batteries".

*Primary Examiner*—Laramie E. Askin

*Attorney, Agent, or Firm*—Vidas & Arrett

[57] ABSTRACT

A hermetic, leak-proof, corrosion resistant electrical feedthrough especially for use with implantable pulse generators. The feedthrough includes a titanium or niobium ferrule, an alumina insulator with a niobium braze area thereon positioned within the ferrule and sealed to the ferrule by a braze of gold at the braze area, electrical lead wires of niobium, tantalum, tungsten, molybdenum or alloys thereof extending through corresponding openings in the insulator, and a body of fusible glass joining and sealing each lead wire to the insulator.

9 Claims, 1 Drawing Sheet

IMPLANTABLE PULSE GENERATOR FEEDTHROUGH

BACKGROUND OF THE INVENTION

This invention relates to electrical feedthroughs, particularly for use in implantable pulse generators (IPG) such as heart pacemakers. It is desirable that feedthroughs for such applications be of miniaturized size and be multi-pin i.e., more than one electrical lead. It is also necessary that the feedthroughs be hermetic, corrosion resistant and impervious to body fluids.

Present IPG feedthroughs typically include an alumina insulator through which an electrical lead passes. The lead is brazed to the alumina with gold. The insulator is brazed to a titanium or niobium ferrule with gold as well. The presence of braze material between lead wires and at the lead wire and insulator junction site makes it difficult to electrically isolate the leads from each other in multi-pin configurations, particularly in miniature sizes, as the conductive braze material tends to reduce the insulation resistance between the leads.

SUMMARY OF THE INVENTION

It is thus an object of this invention to provide an improved feedthrough which makes multi-pin configurations possible in miniature sizes. Due to the specific materials utilized, substantially matched expansion or compression joints are provided between the elements of the feedthrough which provides a hermetic, corrosion resistant, fluid-impervious structure.

DESCRIPTION OF THE PREFERRED EMBODIMENT

Figure 1:
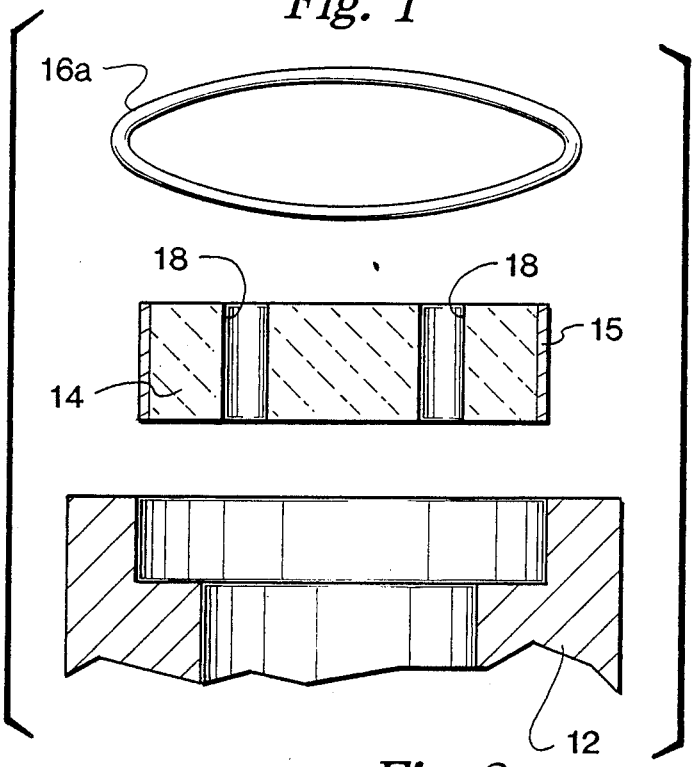
FIG. 1 is a schematic exploded view of some of the structural elements of the feedthrough of the invention ready for assembly.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

Figure 2:
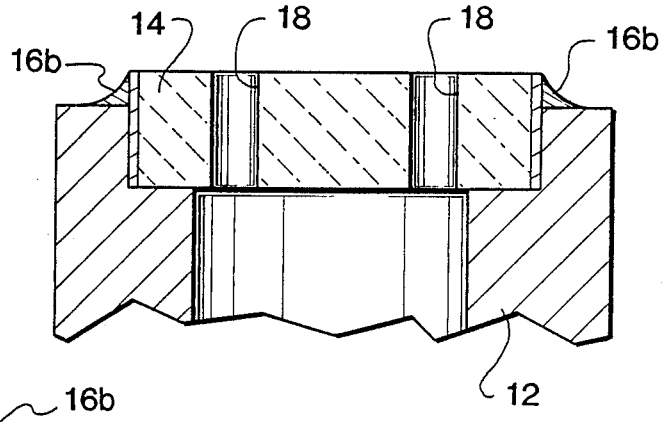
FIG. 2 shows the elements of FIG. 1 in the brazed condition.

Referring to the Figs., several structural elements are shown in assembly consisting of a cylindrical ferrule 12 of titanium or niobium, a flat, round, coin-like-shaped, insulator disc 14 of alumina and a gold washer **16*a* (FIG. 1) which is placed as shown around insulator 14 on ferrule 12. Insulator 14 carries on its peripheral edge surface a vapor deposited coating of niobium 15. Following brazing, gold washer 16*a* forms brazed seal 16*b*, as shown in FIG. 2 between insulator 14 and ferrule 12, involving the niobium 15. It is important that the niobium be restricted to the edge of insulator 14** and not be allowed to reach its faces.

Figure 3:
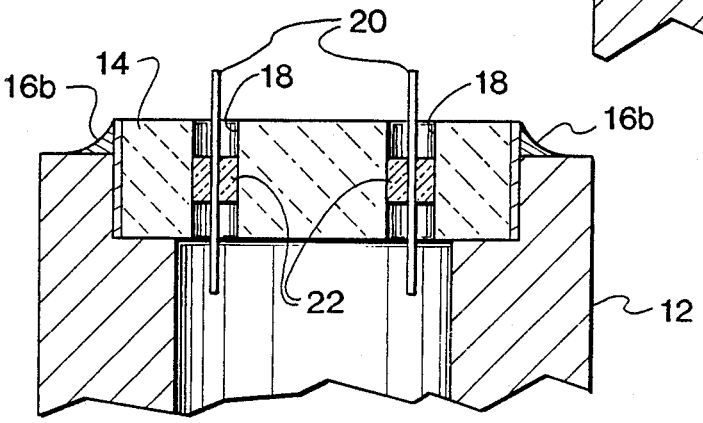
FIG. 3 shows the assembly of FIG. 2 after glassing in the terminal pins.

As can be seen in the Figs., insulator 14 has a plurality of openings 18 through which lead wires or pins 20 (FIG. 3) pass. These elements may be of niobium, tantalum, tungsten, molybdenum, or alloys thereof.

Pins or leads 20 are held in place by fused bodies 22 of glass, preferably fusible at a temperature below that of the brazing temperature of gold. Such glasses are for example:

GLASSES

A. TA23 (low silica type) Manufactured by various sources to composition standards originally established by Sandia National Laboratories:

| | | |
|---|---|---|
| $SiO_2$ | 44.95% | |
| $Al_2O_3$ | 20.0% | |
| $B_2O_3$ | 8.0% | |
| $La_2O_3$ | 2.0% | |
| CaO | 12.0% | |
| MgO | 7.0% | |
| SrO | 6.0% | |
| CoO | 0.05% | (optional) |

B. Pemco 1409P (boroaluminasilicate type): Pemco Products group, Mobay Chemical Corporation, a Division of Bayer U.S.A., Inc., Baltimore, Md.

| | |
|---|---|
| $SiO_2$ | 44% |
| $B_2O_3$ | 29% |
| $Al_2O_3$ | 14.4% |
| MgO | 10.2% |
| CaO | 2.2% |

C. Combinations of A & B, as a blend or single glass composition.

By this is meant that blends of various relative amounts of TA23 and 1409P glass compositions per se may be prepared, respectively by combining TA23 and 1409P compositions directly. On the other hand, compositions can be prepared by combining the individual constituents of the two basic TA23 and 1409P compositions as a single glass composition initially from scratch. In any case, various combinations have been prepared and tested successfully ranging between 0% TA23/100% 1409P to 100% TA23/0% 1409P. The range of most interest is between about 10% TA23/90% 1409P and 90% TA23/10% 1409P because within the ranges of 0–10% and 90–100% TA23 and 1409P not much significant difference in behavior as compared to plain TA23 or 1409P has been observed for the purposes of this invention.

D. In-3} (formerly Kimble) Owens-Illinois, Toledo, Ohio.

| | |
|---|---|
| $SiO_2$ | 65% |
| $B_2O_3$ | 14% |
| $Al_2O_3$ | 7.8% |
| $Li_2O$ | 5.0% |
| $Na_2O$ | 7.6% |
| $K_2O$ | 0.6% |

E. P-2G63} Pemco Products group, Mobay Chemical Corporation, a Division of Bayer U.S.A., Inc., Baltimore, Md.

| | |
|---|---|
| $SiO_2$ | 56.6% |
| $B_2O_3$ | 17.1% |
| $Al_2O_3$ | 5.5% |
| $ZrO_2$ | 11.3% |
| $Na_2O$ | 7.6% |
| CaO | 1.5% |
| MgO | 0.2% |
| ZnO | 0.2% |

There is thus provided a feedthrough of matched compression and expansion characteristics which can be miniaturized and in which the multiple leads are maintained electrically separate from each other.

This completes the description of the preferred and alternate embodiments of the invention. Those skilled in the art may recognize other equivalents to the specific embodiment described herein which equivalents are intended to be encompassed by the claims attached hereto.

What is claimed is:

1. An improved hermetic, leak-proof, corrosion resistant electrical feedthrough, particularly adaptable to miniaturization and multi-pin construction and to IPG use, the feedthrough having substantially matched-expansion/compression joints and comprising:

at least one electrical lead wire consisting essentially of a metal or alloy selected from the group consisting of niobium, tantalum, tungsten, molybdenum and alloys thereof;

an alumina insulator positioned around a portion of the lead wire intermediate the ends thereof, the insulator including a niobium coated braze area electrically remote from the lead wire;

a ferrule consisting essentially of titanium or niobium positioned around the niobium area of the alumina insulator for receiving same in sealing relationship, a braze consisting essentially of gold joining and sealing the ferrule to the insulator in the area of the niobium coating thereon, and a body of fusible glass joining and sealing the lead wire to the insulator.

2. The improved feedthrough of claim 1 in which the glass is of a composition which is fusible at a temperature below that of the brazing temperature of gold.

3. The improved feedthrough of claim 1 in which the glass is 1409P composition.

4. The improved feedthrough of claim 1 in which the glass is TA-23 composition.

5. The improved feedthrough of claim 1 in which the glass is In-3 composition.

6. The improved feedthrough of claim 1 in which the glass is P-2G63 composition.

7. The improved feedthrough of claim 1 including a plurality of lead wires.

8. The improved feedthrough of claim 1 in which the glass is a combination of TA23 and 1409P glass compositions, whether by blending or initial composition preparation from basic constituents.

9. The improved feedthrough of claim 8 in which the combination ranges between 10% TA23/90% 1409P and 90% TA23/10% 1409P in combination.

* * * * *